US007291228B2

(12) United States Patent
Gathright

(10) Patent No.: US 7,291,228 B2
(45) Date of Patent: Nov. 6, 2007

(54) SPRAY SHIELD FOR SPRAY PAINTING INSIDE CORNERS

(76) Inventor: Keith R. Gathright, P.O. Box 472, Princeton, TX (US) 75407

( * ) Notice: Subject to any disclaimer, the term of this patent is extended or adjusted under 35 U.S.C. 154(b) by 712 days.

(21) Appl. No.: 10/640,996

(22) Filed: Aug. 14, 2003

(65) Prior Publication Data

US 2005/0035221 A1 Feb. 17, 2005

(51) Int. Cl.
*B05C 17/12* (2006.01)

(52) U.S. Cl. ..... 118/504; 118/505

(58) Field of Classification Search ..... 118/504, 118/505; 15/257.01, 235.3, 235.4, 235.7, 15/236.01, 245.1; 425/458, 87; 427/282; 294/3.5; 37/278, 285

See application file for complete search history.

(56) References Cited

U.S. PATENT DOCUMENTS 731,419 A * 6/1903 Wyckoff ..... 37/273
2,432,780 A * 12/1947 Mader ..... 37/273
3,090,984 A * 5/1963 Dunnigan ..... 15/235.4
5,442,832 A * 8/1995 Tonsager ..... 15/235.7
5,511,328 A * 4/1996 Fingerer et al. ..... 37/285
5,664,280 A * 9/1997 Tonsager ..... 15/235.7

* cited by examiner

*Primary Examiner*—Laura Edwards
(74) *Attorney, Agent, or Firm*—Michael Diaz

(57) ABSTRACT

A paint shield to enable one operator to efficiently and effectively spray paint interior room corners. The paint shield includes two rigid sheets of material which are joined in a perpendicular orientation. The angle of this joint matches the angle of an interior room wall to wall corner. The paint shield also includes an elongated handle mounted between the sheets and angling away from the joint. The handle may have a telescopic capability. The handle may also be positioned closer to a particular wall. The angle of the handle allows ambidextrous use of the paint shield, while providing unhampered excess for spray painting the ceiling or floor corner. A painter may single handedly hold the shield against a wall corner, while spray painting the exposed ceiling or floor and effectively masking the protected wall surfaces.

9 Claims, 6 Drawing Sheets

SPRAY SHIELD FOR SPRAY PAINTING INSIDE CORNERS

BACKGROUND OF THE INVENTION

1. Technical Field of the Invention

This invention relates to painting accessories, and more particularly to a paint shield enabling one operator to efficiently and effectively spray paint interior room corners.

2. Description of Related Art

While many painting shields have been developed in the past to mask protected areas from paint, most existing devices use a single shield to protect a covered surface. During spray painting operations, the shield is manually held against a top or bottom of a wall to prevent paint from falling on the covered surface. Interior room corners have presented problems for painters. Traditionally, painters have had two choices.

First, while holding the shield against a wall corner, the painter may obtain the help of an assistant. The assistant holds a first paint shield adjacent a second shield held by the painter, thus covering the adjacent exposed wall. Although this option of using an assistant would eliminate most over-spray errors, the painter is forced to work awkwardly around the assistant. With two people working in a corner, the painter often had difficulty in maintaining an even spray pattern.

Secondly, if the painter chooses to work by himself in the limited confines of the corner, the painter is forced to exercise extreme care in preventing over-spray on the unprotected wall. Unfortunately, this solo paint spraying operation has had limited success in preventing unwanted paint over-spray.

A paint spray shield is needed to effectively mask interior wall corners by an individual painter, while simultaneously allowing the painter to paint the associated ceiling or floor corner. It would be advantageous to have such an apparatus to enable a solo operator to efficiently and effectively spray paint an interior corner surface area. It is an object of the present invention to provide such an apparatus.

SUMMARY OF THE INVENTION

In one aspect, the present invention is a paint shield for shielding a surface located in an interior corner. The paint shield includes a first planar sheet material and a second planar sheet material attached to a vertical edge of the first planar sheet of material. The first planar sheet material is attached to the second planar sheet material at an approximately perpendicular orientation. The paint shield also includes an elongated handle attached to the first planar sheet material and to the second planar sheet material on an interior of a junction between the first planar sheet material and the second planar sheet material. The handle is approximately centered between the first planar sheet material and the second planar sheet material.

In another aspect, the present invention is a paint shield for shielding a surface located in an interior corner. The paint shield includes a first planar sheet material having a first vertical edge and a second planar sheet material having a second vertical edge which is attached to the first vertical edge of the first planar sheet of material. A relative angle between the first planar sheet material and the second planar sheet material may be adjusted to conform to a relative corner angle of the interior corner. The paint shield also includes an elongated handle attached to the first planar sheet material and to the second planar sheet material on an interior of a junction between the first planar sheet material and the second planar sheet material. The handle is approximately centered between the first planar sheet material and the second planar sheet material.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

Figure 1:
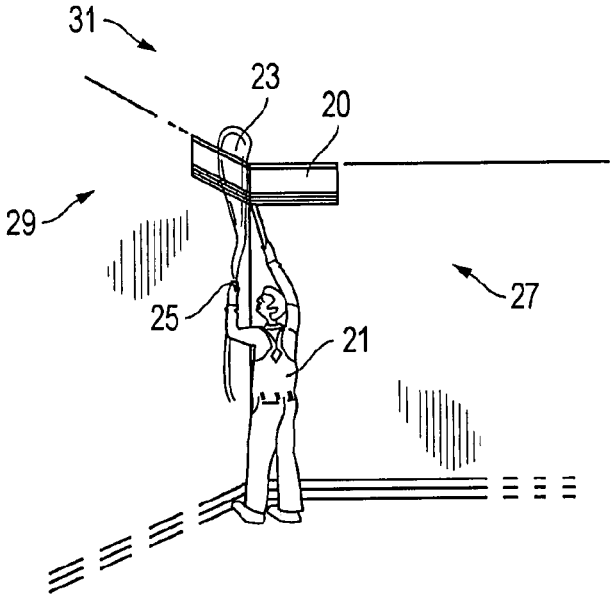
FIG. 1 is a front perspective view showing a painter holding a corner paint shield against a wall corner while painting the associated ceiling in the preferred embodiment of the present invention.

A corner paint shield for solo spray painting of interior room corners is disclosed. FIG. 1 illustrates a solo painter 21 standing in an interior room corner defined by a first wall 27 joining a second wall 29 and a ceiling 31. The painter is holding a corner paint shield 20 masking the wall corner in one hand, while operating a spray gun 25 with the other hand and spray painting a pattern 23 on the ceiling 31.

Figure 2:
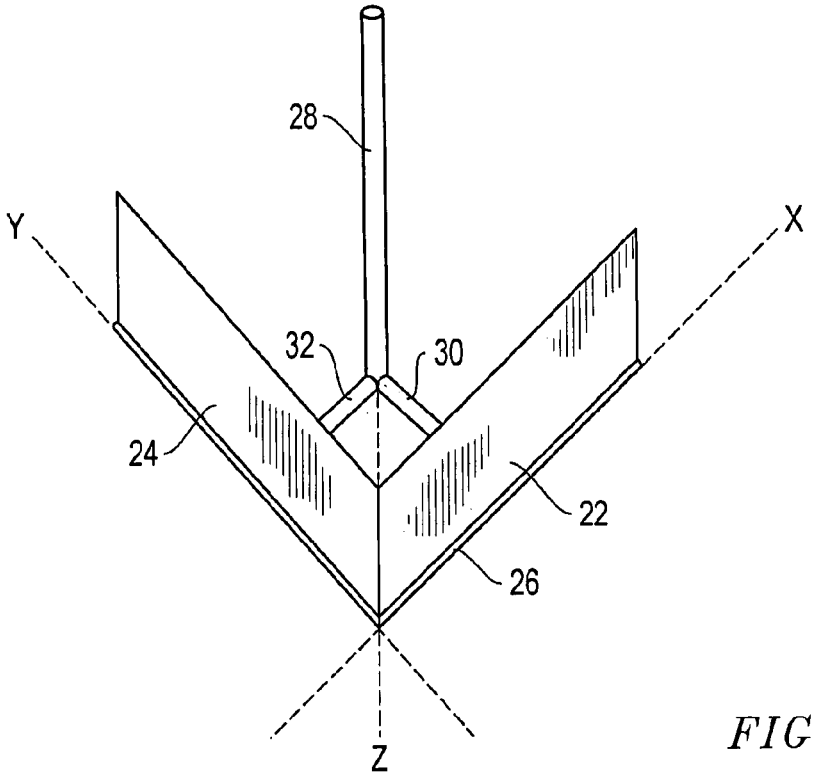
FIG. 2 is a rear perspective view of the corner paint shield inverted for floor painting operations viewed from the surface of the shield oriented toward a wall away from the painter.

FIG. 2 is a rear perspective view the corner paint shield 20 of FIG. 1 in an inverted position. The corner spray shield includes a planar sheet material 22. The planar sheet material 22 may be composed of any rigid material, such as metal or plastic and is preferably bent longitudinally with a lip 26. The lip enables the corner spray shield to snugly fit into a room corner allowing for irregularities of the masked wall. The sheet material 22 may be bent away from the lip ninety degrees (near its respective midpoint) forming an approximately ninety-degree corner. Alternatively, the sheet material 22 may also be attached to a similarly lipped sheet material 24 at each sheet material's respective end to form a ninety-degree corner. The corner is braced with a first bracket 30 and a second bracket 32, to maintain the ninety-degree angle. These brackets are also attached to an elongated handle 28.

Figure 3:
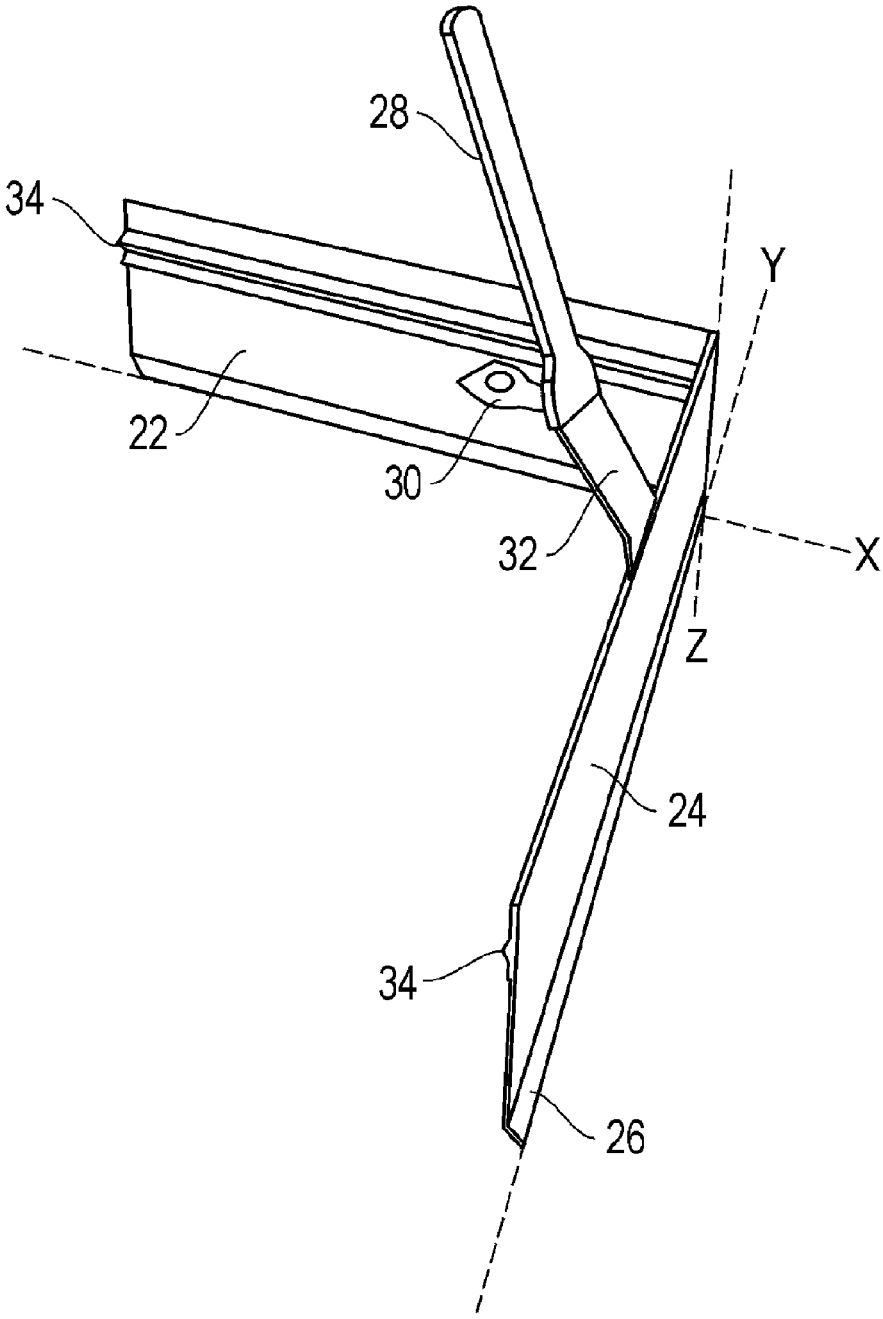
FIG. 3 is a front perspective view of the corner paint shield in an inverted position.

FIG. 3 illustrates a front inverted view of the corner paint shield 20 shown in FIG. 1. The view of FIG. 3 from the painter's perspective more clearly shows the bracing of the brackets 30 and 32 to the planar sheet materials 22 and 24. The brackets hold the elongated handle 28 centered on the X and Y axis, while also holding the handle on a fixed angle in respect to the Z axis. The centered fixed angle more readily allows the painter to apply equal force to the sheet materials 22 and 24, thus effectively masking the wall corner for spray painting. The brackets' orientation away from the lip 26 also allows the painter an unhindered spray area directly to the wall corner.

In addition, FIG. 3 illustrates a reinforcing ridge 34 on the planar sheet material 22. In the preferred embodiment of the present invention, the ridge is on the opposite side of the lip 26 and orientated toward the interior of the ninety-degree angle of the sheet material. This ridge strengthens the sheet material and aids in catching paint drippings. A similarly configured sheet material 24 may also include a lip 26 and a reinforcing ridge 34.

Figure 4:
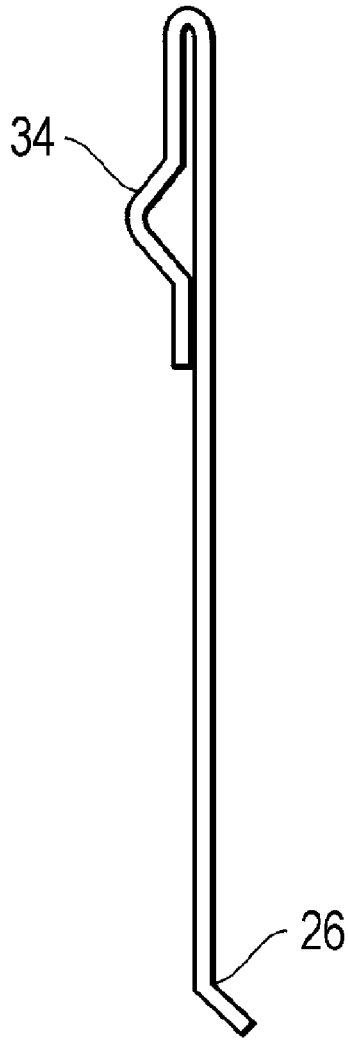
FIG. 4 is a side view of a planar sheet material of the paint shield of FIG. 3.

FIG. 4 illustrates a side view of the sheet material 24 in FIG. 3 along the Z axis. The reinforcing ridge 34 may be formed by bending the sheet material upon itself with a raised ridge. The lip 26 may be formed by bending the sheet material to a slight angle. The lip is preferably on the opposite side of the sheet material as the reinforcing ridge.

Figure 5:
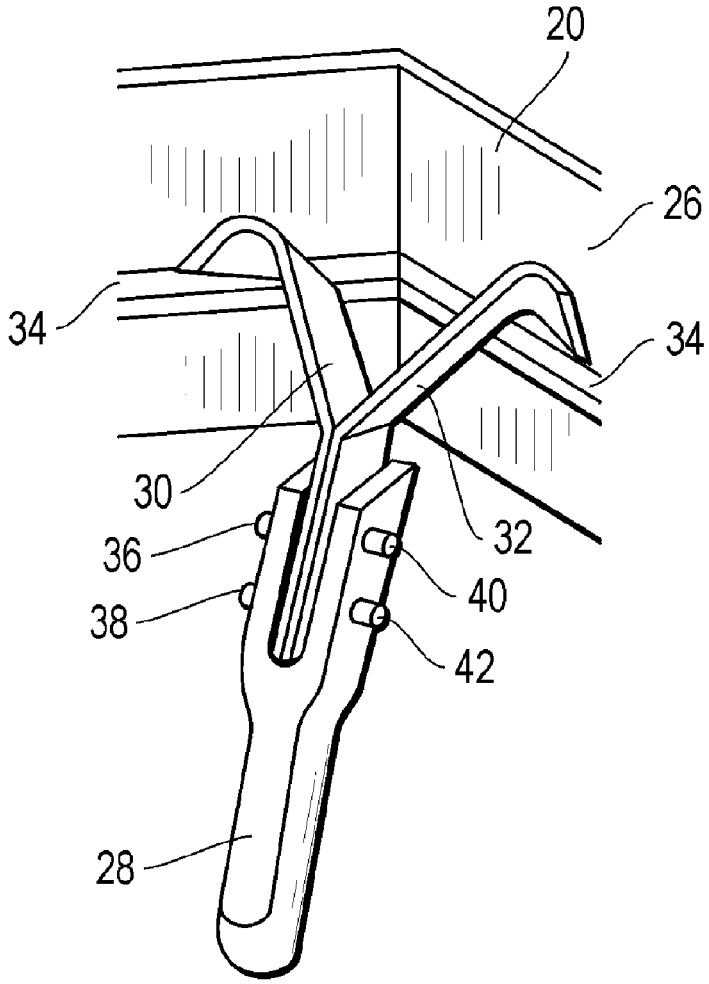
FIG. 5 is a front perspective of the handle to shield connection.

FIG. 5 is a front perspective view of the elongated handle 28 to the brackets 30 and 32 connection in the preferred embodiment of the present invention for use in a square interior room corner. The two brackets are fitted into a slot in the elongated handle. The two brackets may be anchored by through bolts 36 and 38 and associated nuts 40 and 42.

With reference to FIGS. 1 through 5, the operation of the corner paint shield will now be explained. In the preferred embodiment illustrated in FIG. 1, the corner paint shield is held in one hand by the painter 21 using the elongated handle 28. The corner paint shield is positioned against the vertical interior wall corner formed by walls 27 and 29 in conjunction with ceiling 31. The painter, using the paint spray gun 25 in the painter's other hand, spray paints the exposed ceiling with the spray pattern 23. The centered fixed angle of the elongated handle facilitates ambidextrous use of the corner paint shield and quick yet careful placement of the masking planar sheet material into the wall corner. The fixed angle also facilitates an unhampered paint gun to ceiling corner spray pattern area, thus enabling the painter to more easily spray paint the ceiling with an even coating of paint.

Similarly, the corner paint shield may be inverted as viewed in FIG. 3 and held by one hand into the wall to floor corner. The painter, using another hand, spray paints the exposed floor corner.

Figure 6:
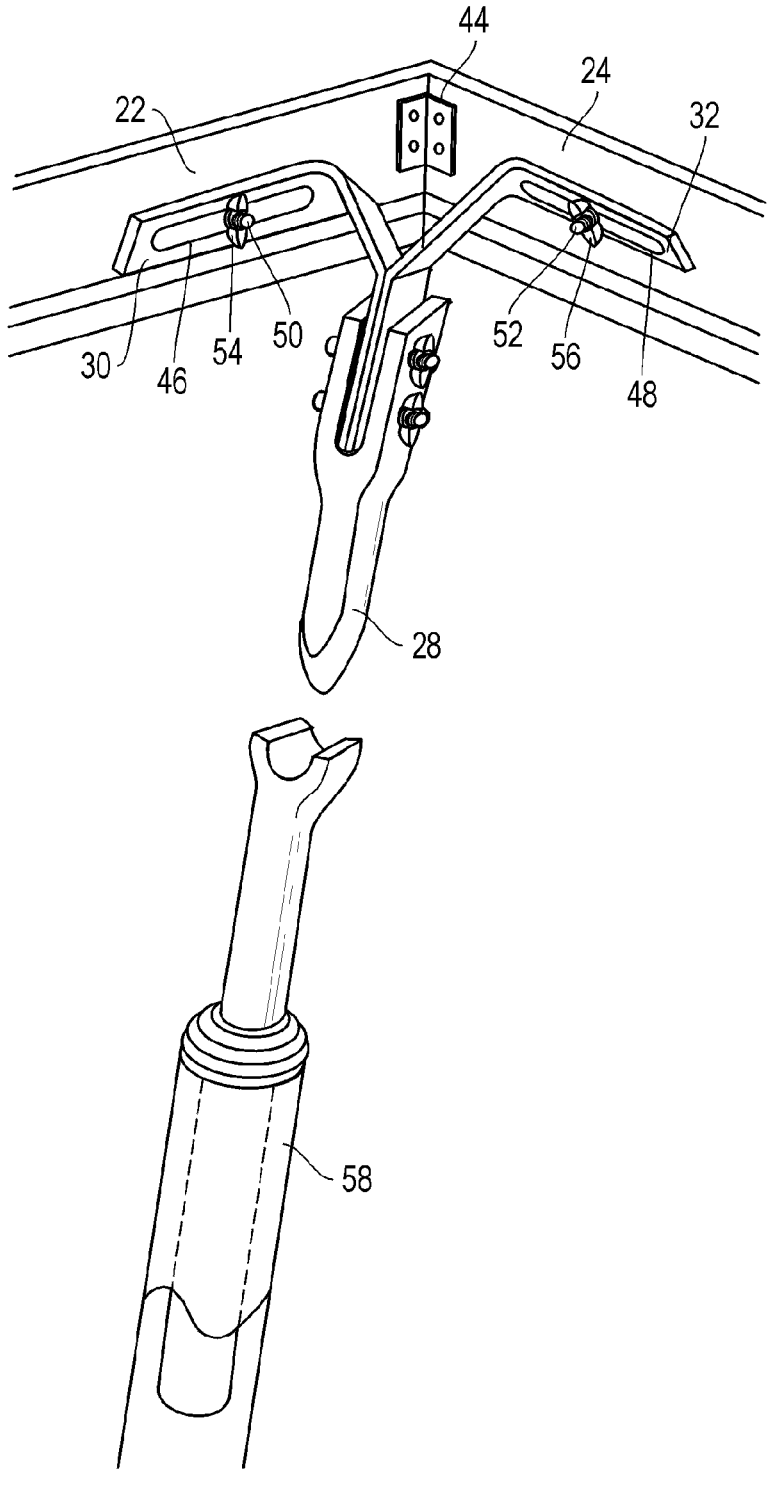
FIG. 6 is a front perspective of a first alternate embodiment of the handle to shield connection.

FIG. 6 is a front perspective view of the corner paint shield 20 to handle 28 connection adapted for angular adjustment for use in interior room corners that are not square. The planar sheet materials 24 and 22 are hinged at their respective ends along the Z axis. A hinge 44 may be used to facilitate the joint. The brackets 30 and 32 are elongated and slotted with slots 46 and 48. The slots allow threaded bolts 50 and 52 to pass through the respective slot. Bolt 50 is anchored to sheet 22 and bolt 52 is anchored to sheet 24. Both slots are sized to allow the bolts to slide freely through the range of the slotted brackets. Nuts 54 and 56 are used to tighten the brackets to hold the desired angle of sheet 22 to sheet 24.

In addition, FIG. 6 illustrates the elongated handle 28 having a telescoping pole 58. The telescoping pole may be incorporated with the preferred embodiment for square room corners or the alternative embodiment for non-square room corners to provide an elongated handle of various lengths tailored for the specific room painting operation.

With regard to FIG. 6, the operation of a corner paint shield angularly adjustable to non-square interior room corners will now be explained. Nuts 54 and 56 are loosened. The planar sheet materials 22 and 24 are spread to the desired wall corner angle using the hinging means 44. The nuts 54 and 56 are tightened to prohibit further movement of bolt 50 in slot 46 or bolt 52 in slot 48. The painter holds the corner paint shield with one hand against the wall corner angle, pressing the lips of the planar sheet material against the ceiling. The painter uses his other hand to spray paint into the exposed ceiling corner. Similarly, the angularly adjustable corner paint shield may be inverted to paint a non-square floor interior room corner.

The painter may also use the adjustment characteristics inherent within the embodiment of FIG. 6 to offset the elongated handle from the center of the X and Y axis. By holding the hinged planar sheets at the desired angle, the loosened bracket to handle connection may be moved left or right toward the X or Y axis until the full range of the slots is reached. Thus if the painter requires more room on the left or right side of the corner, the handle may be adjusted accordingly and subsequently tightened for use.

A painter may also have the option of using the alternative embodiment of the telescoping pole. The pole may be adjusted to the desired length and the corner paint shield may be positioned with one hand in the desired corner. Alternatively, the pole may be leveraged against the floor to support the corner shield into the desired wall corner, thus allowing the painter the use of two hands for spray painting.

Figure 7:
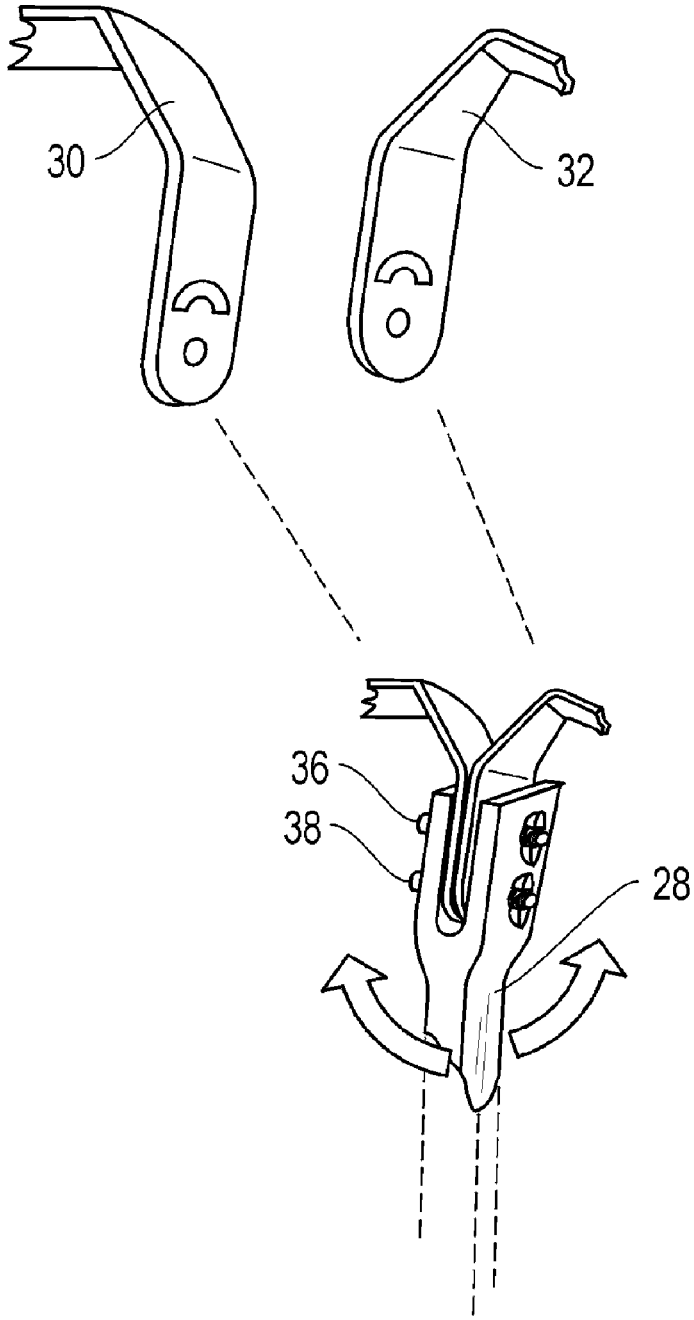
FIG. 7 is a front perspective of a second alternate embodiment of the handle to bracket in a rotatable connection.

FIG. 7 is a front perspective view of a rotatable bracket to handle connection. The brackets 30 and 32 are modified by rounding the bottom edge of each bracket that fits into the slotted handle 28. The bolt hole for bolt 36 in each bracket is elongated and arched. The arching of the bolt holes and the rounding of the bottom of the brackets, allows the handle to pivot about bolt 38. Thus, the handle 28 may pivot through the range of the arch on the Z axis. The painter may thus rotate the elongated handle along the Z axis. The handle may be positioned closer or farther away from the wall corner in the manner discussed above to suit an individuals preferences.

Although the spray shield is utilized primarily to protect specified interior corner areas during spray painting, it should be understood that the present invention may be used to cover any area having an approximately ninety-degree corner.

It is thus believed that the operation and construction of the present invention will be apparent from the foregoing description. While the device shown and described has been characterized as being preferred, it will be readily apparent that various changes and modifications could be made therein without departing from the scope of the invention as defined in the following claims.

What is claimed is:

1. A paint shield for shielding a surface located in an interior wall corner, said paint shield comprising:

a first planar sheet material;

a second planer sheet material attached to a vertical edge of said first planar sheet of material said first planar sheet material attached to said second planar sheet material at an approximately perpendicular orientation; and an elongated handle attached to said first planer sheet material and to said second planar sheet material on an interior of a junction between said first planar sheet material and said second planar sheet material, said handle being approximately centered between said first planar sheet material and said second planar sheet material and fixed at an angle away from an axis extending from the junction, wherein said first planar sheet material includes a first reinforcing ridge along a length of said first planar sheet material, the first ridge being orientated toward the interior of said junction; wherein said first planar sheet material includes a first lip being along the length of said first planar sheet material, the first lip being orientated away from the interior of the junction and away from said handle; wherein said second planar sheet material includes a second reinforcing ridge along a length of said second planar sheet material, the second ridge being oriented toward the interior of said junction; wherein said second planar sheet material includes a second lip bent along the length of said second planar sheet material, the second lip being orientated away from the interior of the junction and away from the handle; and wherein said elongated handle is adjustable for leveraging against flooring to support the corner shield into the wall corner.

2. The paint shield of claim 1 wherein said elongated handle may be telescopically extended.

3. The paint shield of claim 1 wherein said elongated handle has adjusting means to rotatably adjust and lock said handle's angle relative to the junction of said first and second planar sheet material while remaining approximately centered between said first and said second planar sheet material.

4. The paint shield of claim 1 wherein said elongated handle may be adjustably rotated and locked into a desired angle relative to the junction while remaining approximately centered between said first and second planar sheet material.

5. A paint shield for shielding a surface located in an interior wall corner,said paint shield comprising:

a first planer sheet material having a first vertical edge;

a second planar sheet material having a second vertical edge attached to the first vertical edge of said first planer sheet of material;

means for adjusting a relative angel between said first planar sheet material and said second planar sheet material; and an elongated handle attached to said first planar sheet material and to said second planar sheet material on an interior of a junction between said planar sheet material and said second planar sheet material, said handle being approximately centered between said first planar sheet material and said second planar sheet material and fixed at an angel away from an axis extending from the junction;

whereby the relative angel between said first planar sheet material and said second planar sheet material is adjusted to conform to a relative corner angel of the interior corner said first planar sheet material includes a first reinforcing ridge along a length of said first planar sheet material, the first ridge being orientated toward the interior of said junction; said first planar sheet material includes a first lip bent along the length of said first planar sheet material, the first lip being orientated away from the interior of the junction and away from the handle; said second planar sheet material includes a second reinforcing ridge along a length of said second planar sheet material, the second ridge being orientated toward the interior of said junction; said second planar sheet material includes a second lip bent along the length of said second planar sheet material, the second lip bent along the length of said second planar sheet material, the second lip being orientated away from the interior of the junction and away from the handle, and the elongated handle is adjustable for leveraging against flooring to support the corner shield into the wall corner.

6. The paint shield of claim 5 wherein said means for adjusting a relative angel between said first planar sheet material and said second planar sheet material includes a hinge positioned between the first vertical edge and the second vertical edge.

7. The paint shield of claim 6 wherein said handle includes means for supporting and locking the selected relative angle between said first planar sheet material and said second planar sheet material.

8. The paint shield of claim 5 wherein said elongated handle may be telescopically extended.

9. The paint shield of claim 5 wherein said elongated handle may be adjustably rotated and locked into a desired angle relative to the junction while remaining approximately centered between said first and second planar sheet material.

* * * * *